US005258768A

United States Patent [19]

Smith

[11] Patent Number: 5,258,768

[45] Date of Patent: Nov. 2, 1993

[54] DUAL BAND FREQUENCY REUSE ANTENNA

[75] Inventor: Terry M. Smith, La Honda, Calif.

[73] Assignee: Space Systems/Loral, Inc., Palo Alto, Calif.

[21] Appl. No.: 908,938

[22] Filed: Jul. 6, 1992

Related U.S. Application Data

[63] Continuation of Ser. No. 559,034, Jul. 26, 1990, abandoned.

[51] Int. Cl.[5] ..... H01Q 13/00

[52] U.S. Cl. ..... 343/786; 343/756; 343/909; 343/772

[58] Field of Search ..... 343/786, 756, 909, 772, 343/775, 784, 840

[56] References Cited

U.S. PATENT DOCUMENTS

| | | | |
|---|---|---|---|
| 3,274,604 | 9/1966 | Lewis | 343/786 |
| 3,369,197 | 2/1968 | Giger et al. | 343/786 |
| 3,394,375 | 7/1968 | Vice et al. | 343/756 |
| 3,731,236 | 5/1973 | Di Tullio et al. | 343/756 |
| 3,754,271 | 8/1973 | Epis | 343/756 |
| 4,387,377 | 6/1983 | Kandler | 343/756 |
| 4,420,756 | 12/1983 | Hamada et al. | 343/786 |
| 4,477,815 | 10/1984 | Brunner et al. | 343/756 |
| 4,479,128 | 10/1984 | Brunner et al. | 343/756 |
| 4,630,059 | 12/1986 | Mörz | 343/787 |
| 4,652,886 | 3/1987 | Rosser et al. | 343/756 |
| 4,901,086 | 2/1990 | Smith | 343/756 |

*Primary Examiner*—Donald T. Hajec
*Assistant Examiner*—Hoanganh Le
*Attorney, Agent, or Firm*—Robert Guillot; Edward J. Radlo; Greg T. Sueoka

[57] ABSTRACT

A dual frequency band antenna (10) having frequency reuse capability. The antenna waveguide (12) includes a four port waveguide network which transmits and receives orthogonal, linearly polarized signals of each of two frequencies. A pyramidal horn (14) is engaged to the mouth of the waveguide, and a meanderline polarizer (16) is engaged to the aperture (17) of the horn (14) to convert the signals from linear polarizations to circular polarizations.

7 Claims, 4 Drawing Sheets

DUAL BAND FREQUENCY REUSE ANTENNA

This is a File Wrapper continuation application of U.S. Pat. application Ser. No. 07/559,034, filed Jul. 26, 1990, now abandoned.

BACKGROUND OF THE INVENTION

1. Field of the Invention

This invention relates to antennas having frequency reuse capabilities, and more particularly to antennas having a four port network or quadruplexer located in the antenna waveguide, a feed horn attached to the waveguide, and a polarizer disposed at the aperture of the antenna for converting linearly polarized signals to circularly polarized signals.

2. Description of the Prior Art

It has become well known in the field of satellite communications to utilize a single antenna to transmit and receive signals in two frequency bands with two orthogonal, linearly polarized signal components within each band. Waveguides that incorporate such features are known as four-port networks and/or quadruplexers. U.S. Pat. No. 4,630,059 issued to Morz on Dec. 16, 1986 teaches a four-port network suitable for satellite communication. Two orthogonal ports of the Morz waveguide are utilized to introduce orthogonal linearly polarized signals in the four GHz band which are converted to circularly polarized signals in the throat of the waveguide for transmission through the grooved conical horn. Two other orthogonally disposed ports are arranged to receive linearly polarized signals in the six GHz band.

Another prior art four port waveguide network antenna has been designed by COMSAT Laboratories. This device includes two coaxial waveguides, the outer waveguide being used for the transmission and reception of the four GHz band and the inner coaxial waveguide being utilized for the six GHz band. A tunable configuration of screws and baffles within the waveguides are utilized to convert the linearly polarized signals into circularly polarized signals. The device utilizes a grooved conical horn to transmit and receive signals.

Additional prior art antennas that are of interest include those described in U.S. Pat. No. 4,797,681 to Kaplan et. al. on Jan. 10, 1989; U.S. Pat. No. 4,707,702 issued to Withers on Nov. 17, 1987; U.S. Pat. No. 4,573,054 issued to Bouko et. al. on Feb. 25, 1986; U.S. Pat. No. 4,358,770 issued to Satoh et. al. on Nov. 9, 1982; U.S. Pat. No. 4,219,820 issued to Crail on Aug. 26, 1980 and U.S. Pat. No. 3,898,667 issued to Raab on Aug. 5, 1975.

The efficiency of a satellite antenna which transmits and receives different information utilizing orthogonal polarizations of the same frequency band depends to a significant measure upon the elimination of cross-polarization between the orthogonal polarized signals. It is known that a circularly polarized signal can be reduced to a linearly polarized signal utilizing a meanderline polarizer. Such meanderline polarizers produce minimal cross-polarization and therefore promote efficiency. U.S. Pat. No. 3,754,271 issued to Epis on Aug. 21, 1973 describes a meanderline polarizer having a plurality of stacked substantially identical arrays of laterally spaced square-wave shaped meanderlines. The device is positioned at the aperture of a pyramidal horn for conversion of circularly polarized waves into linearly polarized waves.

SUMMARY OF THE INVENTION

The present invention is a dual frequency band antenna (10) having frequency reuse capability. The antenna waveguide (12) includes a four port waveguide network which transmits and receives orthogonal, linearly polarized signals of each of two frequencies. A pyramidal horn (14) is engaged to the mouth of the waveguide, and a meanderline polarizer (16) is engaged to the aperture (17) of the horn (14) to convert the signals from linear polarizations to circular polarizations. The meanderline polarizer (16) includes five separated layers of meanderlines, wherein the first and fifth layers (50 and 58 respectively) include identical meanderlines, the second and fourth (52 and 56 respectively) layers include identical meanderlines that differ from those of the first and fifth layers, and the third layer (54) includes meanderlines that differ from the others in the first, second, fourth and fifth layers. It is an advantage of the present invention that it provides a dual band frequency reuse antenna having minimal cross-polarization.

It is another advantage of the present invention that it provides a dual band frequency reuse antenna which includes a linear-to-circular polarization device that is disposed in the aperture of the feed horn to reduce cross-polarization effects that are created within the waveguide and the horn of the antenna.

It is a further advantage of the present invention that it provides a dual band frequency reuse antenna which utilizes an improved meanderline polarizer to provide reduced cross-polarization.

It is yet another advantage of the present invention that it provides a dual band frequency reuse antenna including a four port waveguide network incorporated into a square waveguide, a pyramidal horn and a meanderline polarizer to achieve increased signal gain and reduced cross-polarization.

It is yet a further advantage of the present invention that it utilizes a polarizer fabrication technique that provides dimensional stability over a broad thermal range, whereby the antenna is usable in an earth orbital environment.

The foregoing and other features and advantages of the present invention will be apparent from the following detailed description of the preferred embodiment which makes reference to the several figures of the drawing.

IN THE DRAWING

DETAILED DESCRIPTION OF THE PREFERRED EMBODIMENT

Figure 2:
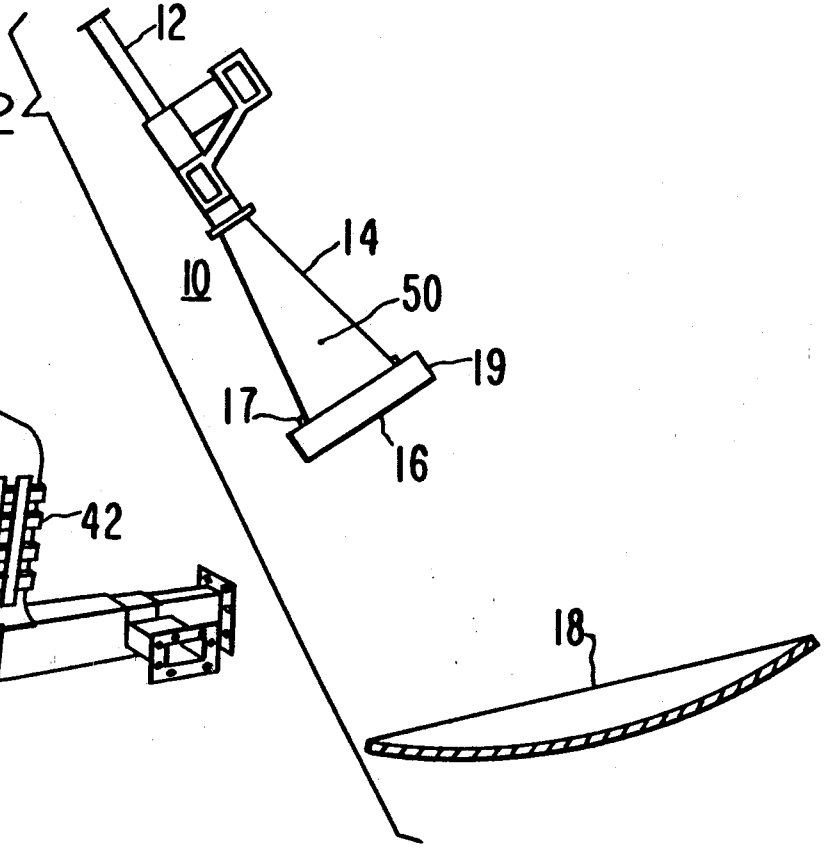
FIG. 2 is a side elevational view of the antenna of the present invention and a reflector.
Figure 1:
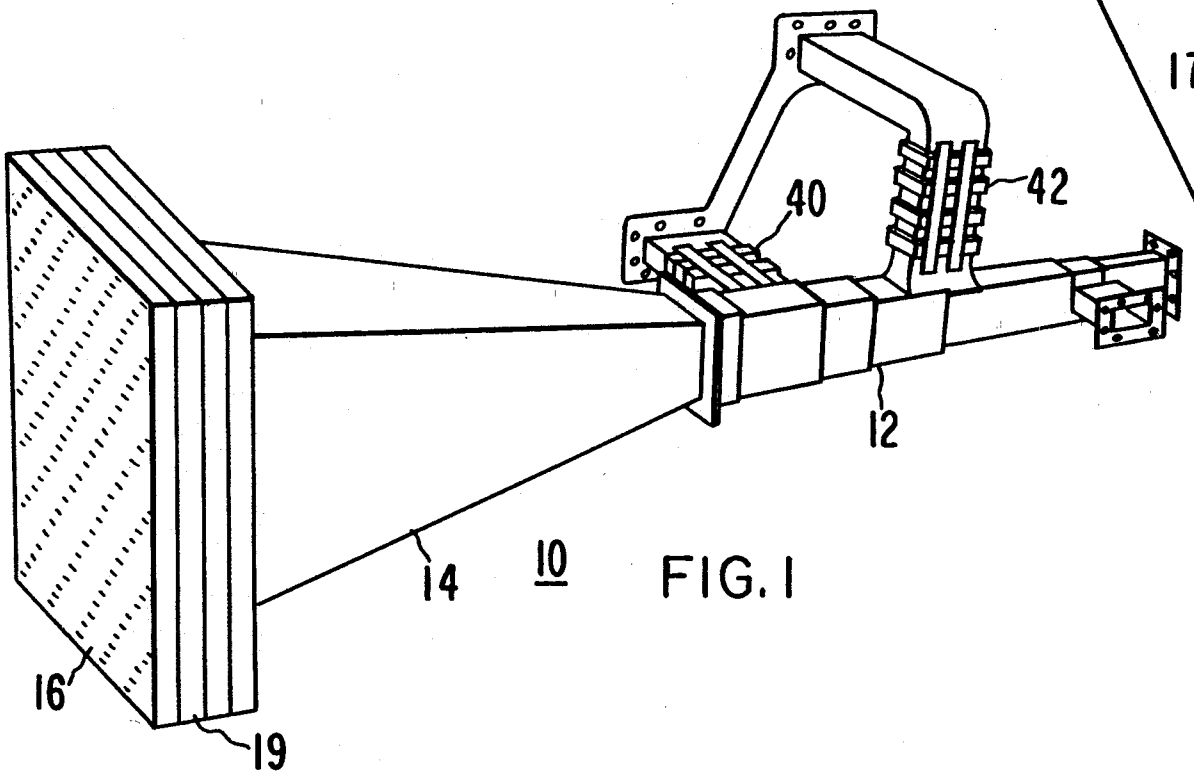
FIG. 1 is a perspective view of the present invention.

As depicted in FIG. 1, the antenna 10 includes three main components, a waveguide 12, a horn 14 and a meanderline polarizer 16 that is attached to the aperture 17 of the horn 14. As depicted in FIG. 2, the antenna 10 is preferably designed to be used with a parabolic reflector 18, such that the antenna 10 is fixedly mounted to a structure (not shown) and the antenna beam is scanned by movement of the reflector 18 relative to the fixedly mounted antenna 10.

Figure 5:
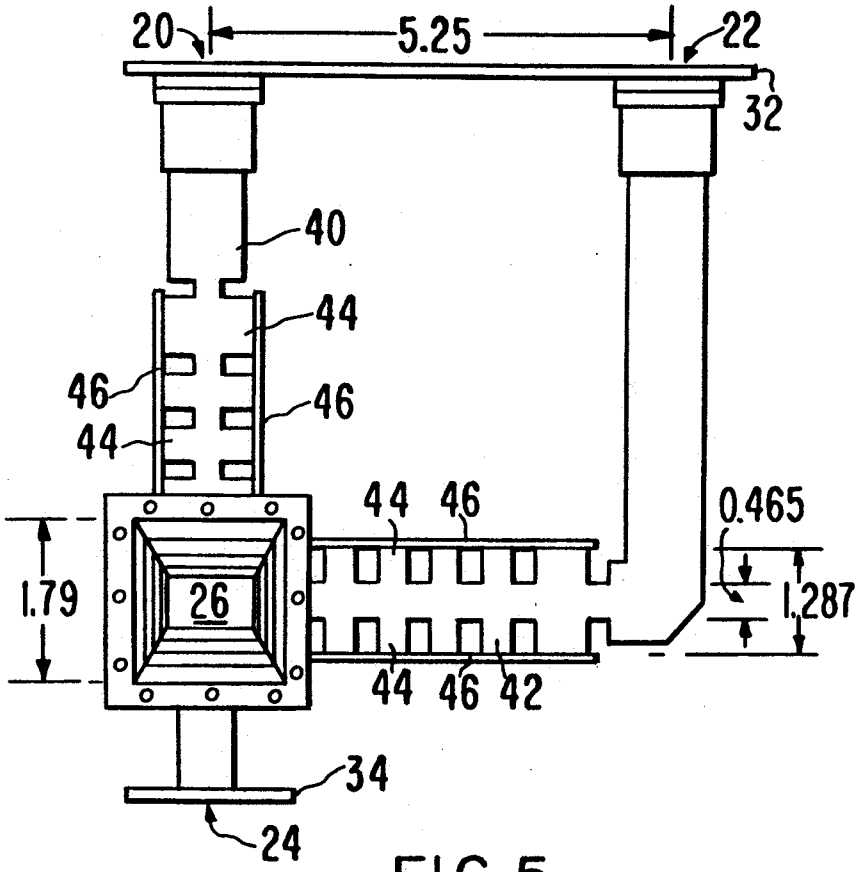
FIG. 5 is an end elevational view of the waveguide of the present invention.
Figure 3:
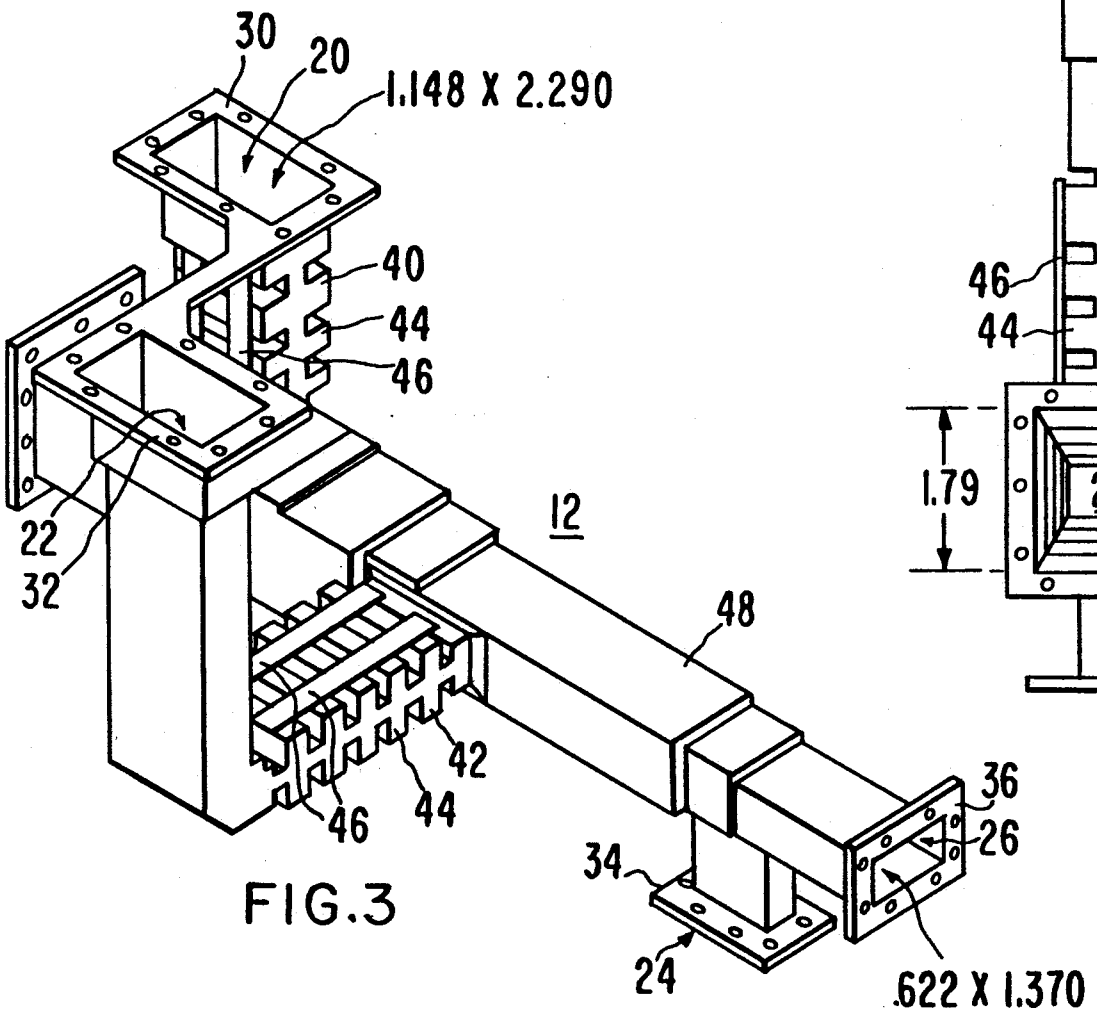
FIG. 3 is a perspective view of the waveguide of the present invention.
Figure 4:
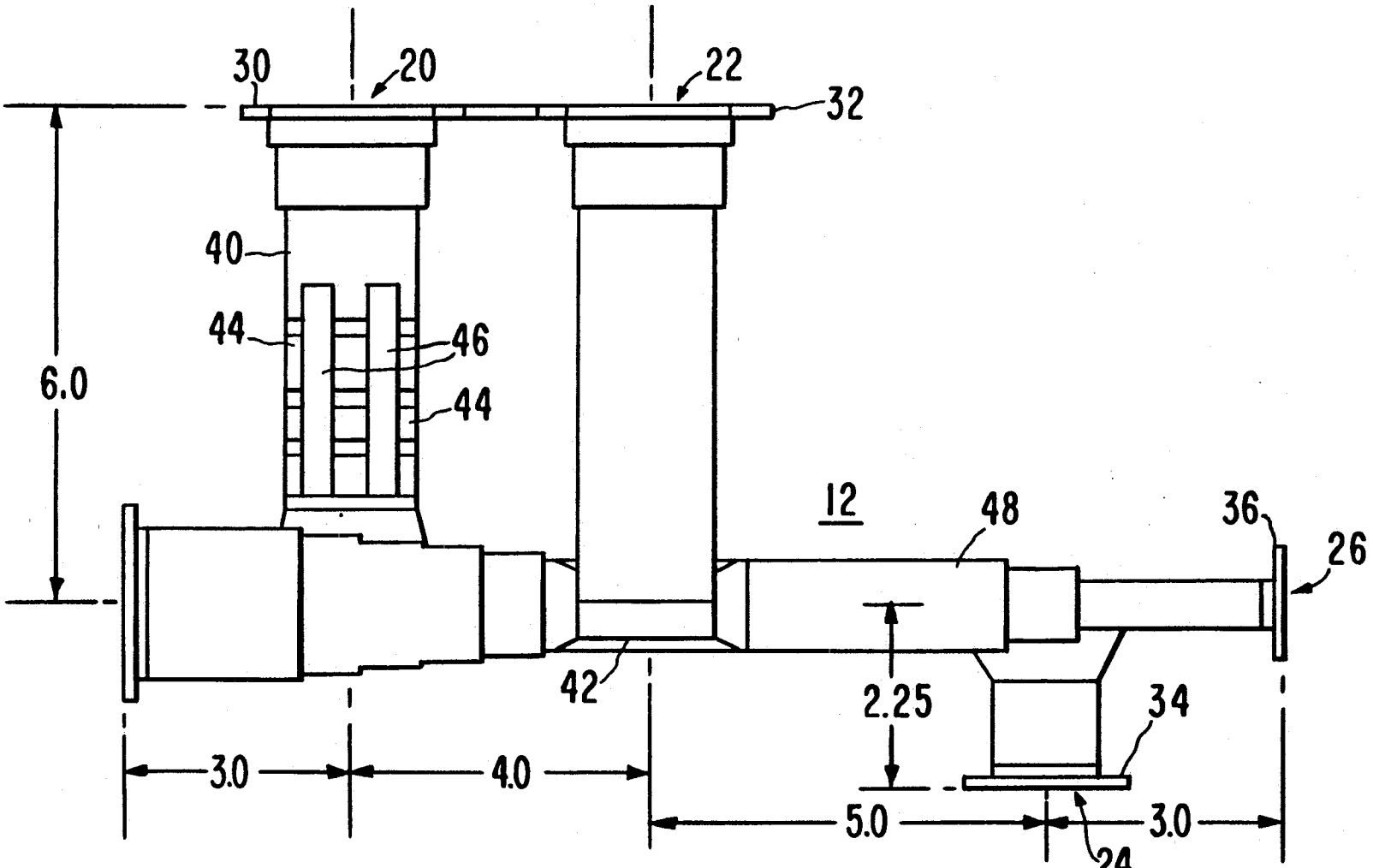
FIG. 4 is a side elevational view of the waveguide of the present invention.

As depicted in FIGS. 3, 4 and 5, the waveguide 12 includes a four port waveguide network. Two of the ports 20 and 22 are designed for the transmission of orthogonal, linearly polarized signals of a first frequency, which in the preferred embodiment is a 4.035 to 4.200 GHz transmission band frequency. The other two ports 24 and 26 are designed for the reception of orthogonal, linearly polarized signals of a different frequency, which in the preferred embodiment is a 6.260 to 6.425 GHz receiving band frequency. The four independent, linearly polarized signals (1 from each port) are coupled into the common square waveguide 12, which in turn excites the pyramidal feed horn 14. At the aperture 17 of the horn 14, the meanderline polarizer 16 then converts the linearly polarized signals to circular polarizations, such that two oppositely, circularly polarized fields are radiated from the antenna 10 at the transmission band frequency. The meanderline polarizer also converts two oppositely, circularly polarized signals to two orthogonal, linearly polarized signals at the receiving band frequency.

Each port 20, 22, 24 and 26 of the four port waveguide network includes an attachment flange 30, 32, 34 and 36 respectively, disposed about its outer end to which signal transmitting or receiving devices (not shown) are coupled. In the preferred embodiment depicted in FIGS. 3, 4 and 5, the orthogonal ports 24 and 26 feed directly into the side and throat respectively of the waveguide 12, whereas orthogonal ports 20 and 22 are provided with additional waveguide structures 40 and 42 respectively which lead to the body of the waveguide 12.

As is known to those skilled in the art, the dimensions of the various waveguide openings and structures are of significance in obtaining acceptable antenna performance. For ease of comprehension and enablement purposes, various significant dimensions, in inches, are provided in FIGS. 3, 4, and 5. The waveguide structures 40 and 42 comprise a series of rectangular corrugations formed perpendicularly to the central axis of the waveguide structures 40 and 42. In the preferred embodiment, support straps 46 are engaged across the outer surface of the corrugations to provide structural rigidity to the waveguide structures 40 and 42. The corrugated waveguide structures 40 and 42 are dimensionally configured to act as a short circuit to the six GHz signals while allowing the four GHz signals to pass therethrough. Thus, the linearly polarized six GHz receiving signal does not propagate into waveguide structures 40 and 42, but rather continues through the body of the waveguide 12 to the ports 24 and 26. Additionally, a central section 48 of the waveguide 12 located behind ports 20 and 22 is dimensionally sized to prevent the propagation of the four GHz transmission signals backwards through the waveguide 12 to the six GHz ports 24 and 26.

In the preferred embodiment, the feed horn 14 is a pyramidal horn having a flare angle of approximately 10 degrees and a square aperture having a side measurement of approximately 6 inches; its aperture 17 is located approximately 3.5 inches towards the reflector 18 from the focal point 50 of the reflector 18.

As is seen in FIG. 1, in the preferred embodiment, the meanderline polarizer is oriented relative to the square aperture 17 of the feed horn 14, such that the meanderlines run diagonally across the aperture 17 of the feed horn 14. The improved meanderline polarizer 16 serves to transform the linearly polarized signals into circularly polarized signals at the aperture 17 of the antenna horn 14. Thus, the signals that propagate within the horn 14 and waveguide 12 are entirely orthogonal, linearly polarized signals, and no circularly polarized signals propagate within the horn 14 or waveguide 12. This configuration results in the transmission and reception within the waveguide of orthogonal, linearly polarized signals with significantly reduced cross-polarization, whereby improved signal gain and reduced noise is achieved.

Figure 6:
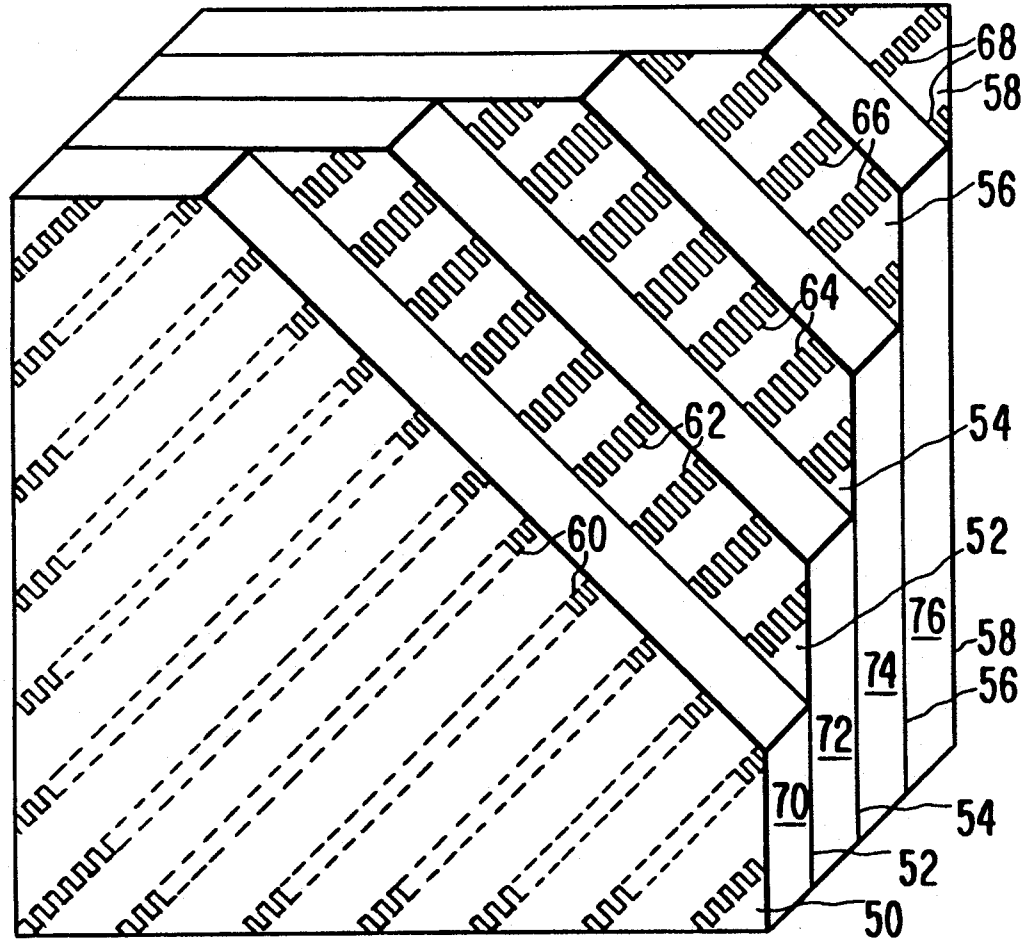
FIG. 6 is a perspective view of the meanderline polarizer of the present invention having cutaway portions.

In the preferred embodiment, as depicted in FIG. 6, the meanderline polarizer 16 is a sandwich structure including five thin layers 50, 52, 54, 56 and 58, each having a plurality of meanderline traces 60, 62, 64, 66 and 68, respectively, formed thereon. Four foam-like spacers 70, 72, 74 and 76 serve to separate the five meanderline layers. The use of meanderline polarizers that are generally configured as described hereinabove is well known in the art, as particularly taught in U.S. Pat. No. 3,754,271 issued to J. Epis on Aug. 21, 1973. A significant difference between the polarizer 16 of the present invention and the prior art polarizers resides in the utilization of meanderline traces of differing dimensions in the various layers 50, 52, 54, 56 and 58. Specifically, the meanderline traces in layers 50 and 58 are identical, the meanderline traces in layers 52 and 56 are identical, although differing in dimensions from the meanderline traces in layers 50 and 58. The meanderline traces in layer 54 are different in dimension from those of any other layer.

Proper selection of the meanderline trace dimensions provides the required dual band conversion to pure circular polarization. In the preferred embodiment, the polarizer is a 9.0" square by 2.0" thick sandwich construction. The sandwich consists of the four spacers 70, 72, 74, and 76 compound of Stanthyne 817 Foam, and the five layers 50, 52, 54, 56 and 58 are composed of etched ½ oz. copper clad 3 mill Kapton bonded together with Hysol 9309 adhesive. Bonding is done so as not to cover the traces. The polarizer is bonded to a fiberglass frame 19 which is bolted to the aperture 17 of the horn 14. The traces are preferably formed on the Kapton layers utilizing printed circuit board techniques to provide close tolerances and reliability to the device.

Figure 7:
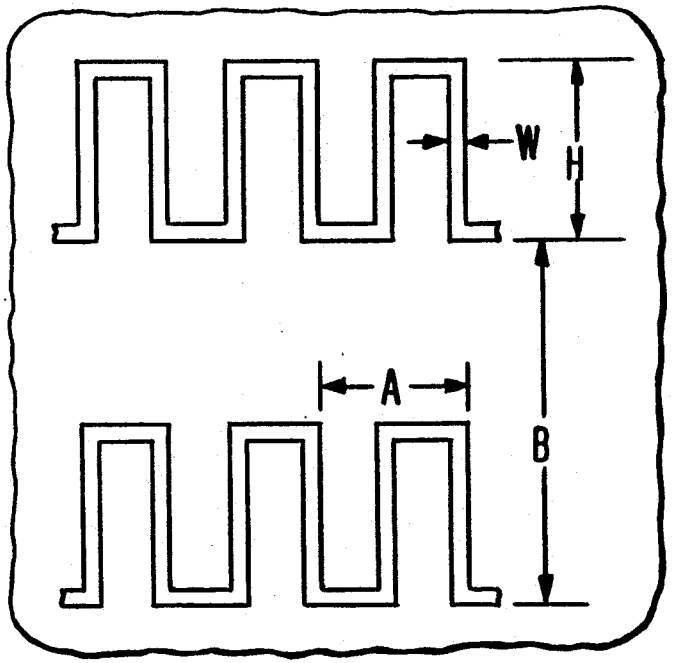
FIG. 7 is a top plan view of portions of the meanderline traces of the meanderline polarizer.

As is depicted in FIG. 7, the dimensions of the meanderline traces in each layer can be expressed by four parameters that are designated as: A, the periodicity of a meanderline trace; H, the height of the meanderline trace; W, the width of the meanderline trace; and B, the distance between adjacent meanderline traces. The following table provides the dimensions for each of the layers of the meanderline polarizer 16.

| | Layers 50 & 58 | Layers 52 & 56 | Layer 54 |
|---|---|---|---|
| A | 0.046 | 0.174 | 0.134 |

-continued

| | Layers 50 & 58 | Layers 52 & 56 | Layer 54 |
|---|---|---|---|
| H | 0.180 | 0.336 | 0.409 |
| W | 0.011 | 0.043 | 0.034 |
| B | 0.782 | 0.782 | 0.782 |

It is advantageous that the present invention provides a reuse frequency capability. That is, that the same frequency can be used for transmitting two signals, one of which is circularly polarized in a first sense and the other of which is circularly polarized in an opposite sense. Additionally, the utilization of four ports in the waveguide network permits the simultaneous utilization of two reuse frequency signals, approximately 4 GHz and approximately 6 GHz. The use of a meanderline polarizer at the aperture 17 of the feed horn 14 provides improved performance as compared to prior art devices which attempt to convert signals from circular polarization to linear polarization within the waveguide. The improved meanderline polarizer reduces cross-polarization and thus contributes to the improved performance of the invention.

While the invention has been particularly shown and described with reference to certain preferred embodiments, it will be understood by those skilled in the art that various alterations and modifications in form and detail may be made therein. Accordingly, it is intended that the following claims cover all such alterations and modifications as may fall within the true spirit and scope of the invention.

What I claim is:

1. A dual band frequency reuse antenna operable at a first frequency band and a second frequency band, said second frequency band being at higher frequencies than said first frequency band, said antenna comprising:

a waveguide having a central section, a throat and four ports, the throat positioned at a first end of the central section for receiving signals at said second frequency band, first and second ports spaced apart at different axial positions along the waveguide near a second end of the central section distal the first end to lead into the waveguide for transmitting orthogonal, linearly polarized signals within the first frequency band, and third and fourth ports positioned to feed into the throat for receiving orthogonal, linearly polarized signals within said second frequency band;

first and second corrugated waveguide structures each having a central axis and rectangular corrugations formed perpendicularly to the corresponding central axis for short circuiting signals of the second frequency band while allowing signals of the first frequency band to pass therethrough, said corrugated waveguide structures coupled between said waveguide and said first and second ports, respectively;

a feed horn being engaged to said waveguide proximate the second end of the central section and adapted to enhance the transmission and reception of signals from and to said waveguide, respectively; and a signal polarizing means being engaged to the aperture of said feed horn and adapted to convert between linearly polarized signals and circularly polarized signals in the first and second frequency bands.

2. A dual band frequency reuse antenna as described in claim 1 wherein said signal polarizing means comprises a meanderline polarizer.

3. A dual band frequency reuse antenna as described in claim 2 wherein said meanderline polarizer comprises a plurality of layers, each said layer comprising a plurality of substantially identical generally squarewaves meanderline traces being formed thereon.

4. A dual band frequency reuse antenna as described in claim 3 wherein said meanderline traces formed on differing layers differ in at least one of the dimensions from the group of dimensions comprising height, width, and periodicity of the squarewave within a meanderline trace.

5. A dual band frequency reuse antenna as described in claim 4 wherein said meanderline traces formed on a first layer differ in said dimensions from said meanderline traces formed on a second layer, and said meanderline traces formed on a third layer differ in said dimensions from said meanderline traces formed on each of said first layer and said second layer.

6. A dual band frequency reuse antenna as described in claim 3 wherein said meanderline polarizer comprises five layers;

said meanderline traces formed on said first and fifth layers are substantially identical in dimensions of height, width, and periodicity of the squarewave within a meanderline trace;

said meanderline traces formed on said second and fourth layers are substantially identical in dimensions of height, width, and periodicity of the squarewave within a meanderline trace, said meanderline traces formed on said second and fourth layers having dimensions which differ from said meanderline traces formed on said first and fifth layers in at least one of the dimensions from the group of dimensions comprising height, width, and periodicity of the squarewave within a meanderline trace; and said meanderline traces formed on said third layer have dimensions which differ from said meanderline traces formed on said first, second, fourth, and fifth layers in at least one of the dimensions from the group of dimensions comprising height, width, and periodicity of the squarewave within a meanderline trace.

7. The antenna of claim 1 wherein the central section, the throat, and the horn all have substantially square cross-sections.

* * * * *